US005359969A

United States Patent [19]

Dickrell et al.

[11] Patent Number: 5,359,969

[45] Date of Patent: Nov. 1, 1994

[54] INTERMITTENT COOLING FAN CONTROL

[75] Inventors: David L. Dickrell, Chillicothe; Kyle W. Scholl, Dunlap; Scott G. Sinn, Morton, all of Ill.

[73] Assignee: Caterpillar Inc., Peoria, Ill.

[21] Appl. No.: 177,876

[22] Filed: Jan. 5, 1994

[51] Int. Cl.[5] ..... F01P 7/02

[52] U.S. Cl. ..... 123/41.12; 123/41.01

[58] Field of Search ..... 123/41.12, 41.11, 41.01, 123/41.13, 41.49

[56] References Cited

U.S. PATENT DOCUMENTS

| | | | |
|---|---|---|---|
| 4,313,402 | 2/1982 | Lehnoff et al. | 123/41.12 |
| 5,002,019 | 3/1991 | Klaucke et al. | 123/41.12 |
| 5,174,248 | 12/1992 | Couëtoux | 123/41.12 |
| 5,224,446 | 7/1993 | Okita et al. | 123/41.12 |

*Primary Examiner*—Noah P. Kamen
*Attorney, Agent, or Firm*—R. Carl Wilbur

[57] ABSTRACT

An electronic engine control is disclosed having an electronic cooling fan control. The cooling fan is turned on or off according to a predetermined strategy and inputs from several engine parameter sensors. By disengaging the cooling fan when it is not needed for engine cooling, the fan control reduces the power that is unnecessarily drawn from the engine to drive the fan.

33 Claims, 3 Drawing Sheets

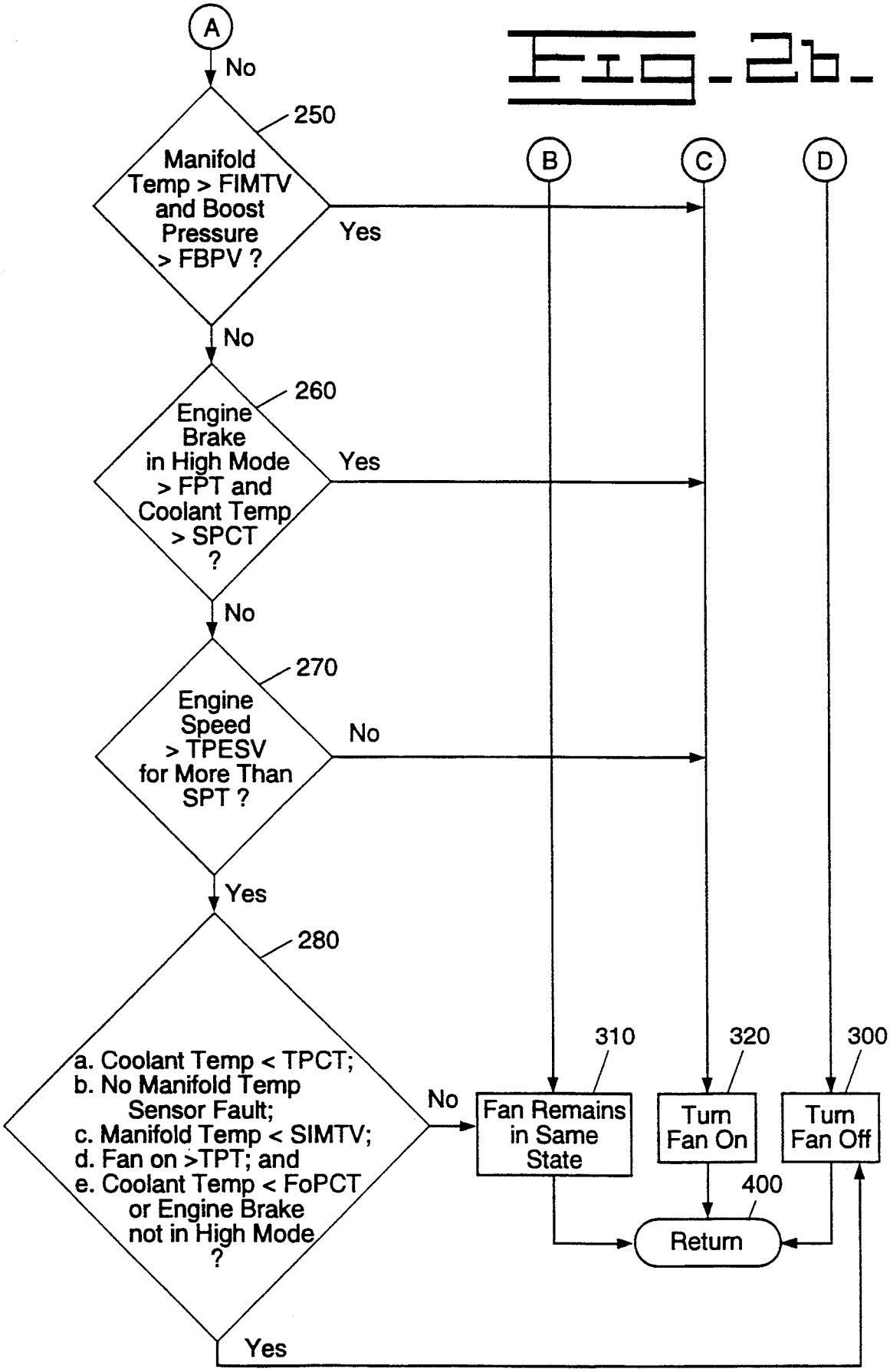
Fig. 2b.
A
No
250
Manifold Temp > FIMTV and Boost Pressure > FBPV ?
Yes
B
C
D
No
260
Engine Brake in High Mode > FPT and Coolant Temp > SPCT ?
Yes
No
270
Engine Speed > TPESV for More Than SPT ?
No
Yes
280
a. Coolant Temp < TPCT;
b. No Manifold Temp Sensor Fault;
c. Manifold Temp < SIMTV;
d. Fan on >TPT; and
e. Coolant Temp < FoPCT or Engine Brake not in High Mode ?
No
310
Fan Remains in Same State
320
Turn Fan On
300
Turn Fan Off
400
Return
Yes

INTERMITTENT COOLING FAN CONTROL

TECHNICAL FIELD OF THE INVENTION

The present invention relates generally to electronic engine controls, and more specifically, to an electronic engine cooling fan control that selectively turns the cooling fan on and off in response to predetermined parameters.

BACKGROUND OF THE INVENTION

Electronic engine controls are known in the prior art. Such engine controls typically input signals from one or more engine parameter sensors and output an injection signal or fuel delivery signal that causes fuel to be introduced into the engine cylinders in accordance with a predetermined fuel delivery schedule.

Engine fans are typically driven by the engine through a series of belts and pulleys or other means. The rotating cooling fan draws air through a radiator, which transfers heat from the engine coolant in the radiator to the air, thereby extracting heat from, and reducing the temperature of, the engine coolant. In this manner, the engine fan helps keep the engine within normal operating temperatures.

In engines equipped with a turbocharger, the fan is often used to draw air through an air-to-air aftercooler. The fan draws air through the aftercooler thereby reducing the temperature of the compressed air as it exits the turbocharger and before it enters the intake manifold. In this manner, the air entering the intake manifold can be maintained within normal operating temperatures.

The power required to operate the cooling fan is sometimes referred to as parasitic power because that power does not contribute to the work output of the engine. To improve the overall efficiency of the engine, it would therefore be desirable to decrease the parasitic power required to operate the cooling fan, or to eliminate entirely the power required by the fan in those instances where the fan is not required to keep the engine within a range of normal operating temperatures.

The present invention is directed to overcoming this and other problems associated with electronic engine controls.

SUMMARY OF THE INVENTION

According to one aspect of the present invention, a control for use with an internal combustion engine is disclosed. The control includes a microprocessor, a memory device electrically connected to said microprocessor, and engine cooling means for drawing air through said radiator, said engine cooling means being electrically connected to said microprocessor. An engine brake is associated with at least one of said combustion cylinders and is electrically connected to said microprocessor. A coolant temperature sensor is attached to said radiator and is electrically connected to said microprocessor. An intake manifold pressure sensor is connected to said intake manifold and is electrically connected to said microprocessor. The microprocessor engages the engine cooling means as a function of inputs from the coolant temperature sensor, the intake manifold pressure sensor, and the engine speed sensor and as a function of an output to the engine brake.

According to another aspect of the present invention, a method of operating an electronic fan control for use with an internal combustion engine is disclosed. The electronic fan control and engine include a plurality of combustion cylinders, an intake manifold, a radiator, a microprocessor, a memory device, engine cooling means for drawing air through said radiator, said engine cooling means being electrically connected to said microprocessor, an engine brake associated with at least one of said combustion cylinders and electrically connected to said microprocessor, a coolant temperature sensor attached to said radiator and electrically connected to said microprocessor, an intake manifold pressure sensor connected to said intake manifold and electrically connected to said microprocessor, and an engine speed sensor electrically connected to said microprocessor. The method includes the steps of comparing said engine speed signal to a value corresponding to a first predetermined engine speed value and disengaging said engine cooling means in response to said engine speed signal exceeding said value corresponding to the first predetermined engine speed value.

DETAILED DESCRIPTION OF A PREFERRED EMBODIMENT OF THE INVENTION

Figure 1:
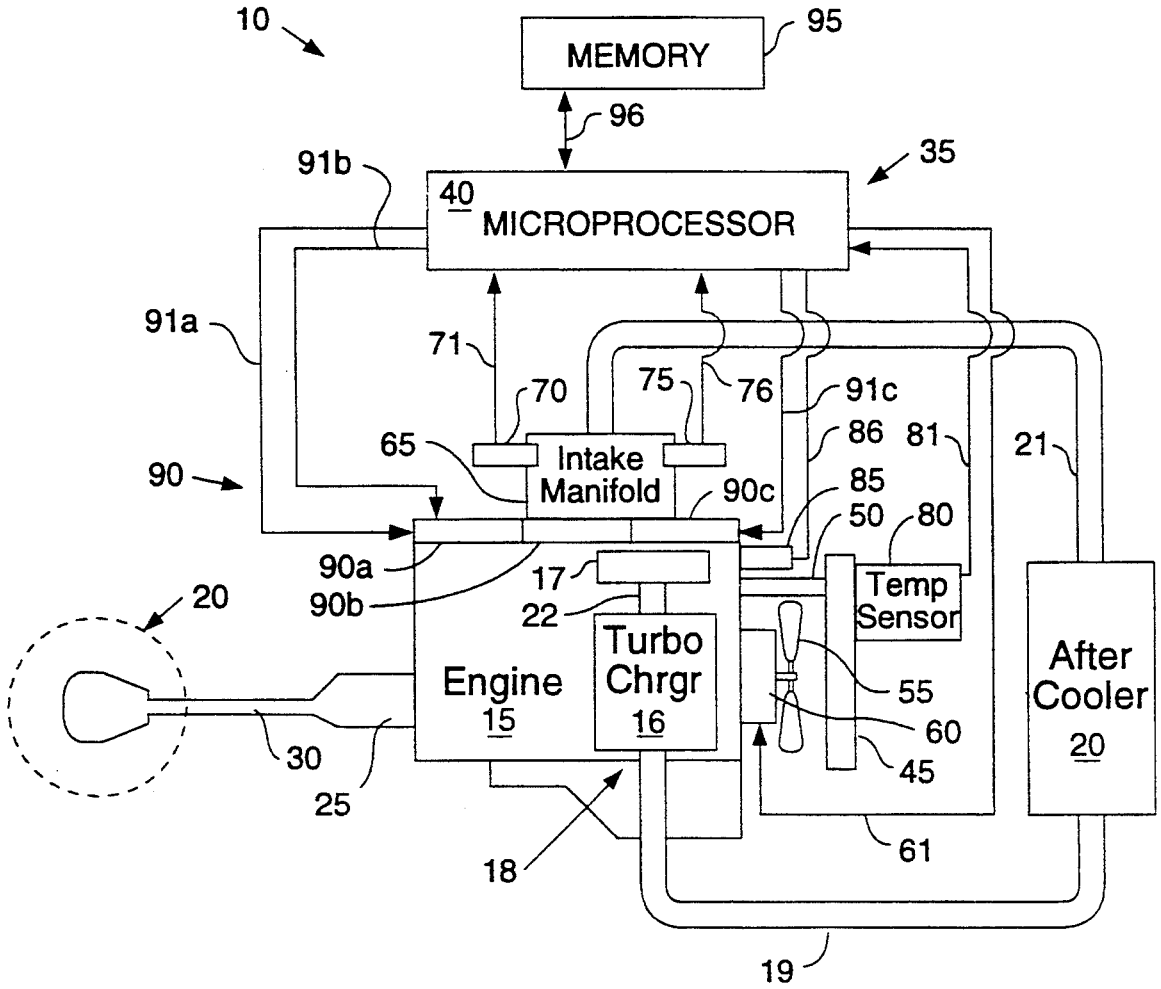
FIG. 1, is a schematic block diagram illustration of a preferred embodiment of the electronic cooling fan control of the present invention.

Referring to FIG. 1, a block diagram of a preferred embodiment of the electronic cooling fan control 10 of the present invention is shown. The cooling fan control 10 includes an internal combustion engine 15, which is connected to a drive wheel 20 or other drive means, through a transmission 25 and drive shaft 30. As is known to those skilled in the art, the engine power is transmitted through the transmission 25 and the drive shaft 30 to a differential or other device (not shown in the figure) which transmits power from the drive shaft 30 to the drive wheel 20 or other drive means causing the drive wheel 20 to rotate, thereby propelling the vehicle. Typically, such systems include a transmission controller that controls shifting between a plurality of gear ratios associated with the transmission 25. Such transmission controllers are well known in the art and are not described further herein.

The engine 15 is connected to a radiator 45 through a hose 50 or other suitable conduit through which engine coolant flows. A cooling fan 55 is connected to the engine 15 through a fan clutch 60. As is known in the art, the cooling fan 55 draws air through the radiator 45 to extract heat from the engine coolant, thereby decreasing the temperature of the engine coolant and the engine.

The cooling fan control 10 includes an electronic controller 35, which in a preferred embodiment comprises a microprocessor 40. In a preferred embodiment, the microprocessor is a Model No. 68HC11, , as manufactured by Motorola, Inc. of Schaumburg, Il. Those skilled in the art will understand that many different commercially available microprocessors may be readily and easily used in connection with the present invention. The present invention is therefore not limited to use of a single model of microprocessor, but instead includes all suitable microprocessors that may be used in connection with the cooling fan control as defined by the appended claims.

The engine 15 may include a turbocharger 16 which is connected to the engine in a conventional manner, as is known in the art. The turbocharger 16 is connected to an air filter 17 via a conduit 22. The turbocharger 16 draws air through the air filter 17 and produces a higher pressure air at the outlet side 18 of the turbocharger 16. The compressed air then flows through a conduit 19 to an air-to-air aftercooler 20 which reduces the temperature of the compressed air, as is known in the art. The cooled compressed air then enters the intake manifold 65 via a conduit 21. The intake manifold 65 transmits air or an air/fuel mixture from a turbocharger or carburetor (not shown) to the individual engine cylinders. Included in the intake manifold 65 is an intake manifold pressure sensor 70 and an intake manifold temperature sensor 75. The intake manifold pressure sensor 70 produces an electrical signal that is a function of the "boost" or air pressure in the intake manifold 65. The "boost" pressure signal is an input to the microprocessor 40 over an electrical conduit 71. Many suitable pressure sensors are known in the art, any one of which may be used in connection with the present invention. In a preferred embodiment, the pressure sensor used is a Model No. 2CP-3-6 manufactured by Texas Instruments, Inc.

Similarly, the intake manifold temperature sensor 75 produces an electrical signal that is a function of the temperature of the air in the intake manifold 65. The air temperature signal is an input to the microprocessor 40 over an electrical conduit 76. Many temperature sensors are known in the art, any one of which may be used in connection with the cooling fan control of the present invention.

A coolant temperature sensor 80 is attached to the radiator 45. The coolant temperature sensor 80 produces an electrical signal that is a function of the temperature of the engine coolant temperature. The engine coolant temperature signal is an input to the microprocessor 40 over an electrical conduit 81.

An engine speed sensor 85 is attached to the engine and produces an electrical signal that is a function of the engine speed. The engine speed signal is an input to the microprocessor 40 over an electrical conduit 86. Many suitable engine speed sensors are known in the art, any one of which may be readily and easily implemented in connection with the present invention. In a preferred embodiment, the engine speed sensor 85 is a sensor as disclosed in U.S. Pat. No. 4,972,332 issued to Luebbering, on Nov. 20, 1990.

Attached to the engine 15 is an engine brake 90. In a preferred embodiment, the engine brake 90 includes a plurality of individual engine brakes 90*a,b,c*. Each individual engine brake 90*a,b,c* is associated with two engine cylinders. Although the present invention is described in connection with three individual engine brakes 90*a,b,c* it should be recognized that fewer than three or more than three such brakes could be readily and easily used without deviating from the scope of the present invention as defined by the appended claims. Such engine brakes are commercially available devices that are known to those skilled in the art. Typically, such engine brake decrease engine speed by causing a piston to compress air in the engine cylinder during the compression stroke, then release the compressed air prior to an expansion stroke. The compressed air is released from the engine cylinder through the exhaust valve to thereby release the stored energy before the energy is returned to the piston during the expansion stroke. Many suitable commercial engine brakes are available, any one of which could be used in connection with the present invention.

The individual engine brakes 90*a,b,c* are controlled by the microprocessor 40. The microprocessor 40 issues individual brake signals over electrical conduits 91*a,b,c* to the respective individual engine brakes 90*a,b,c* to cause the individual brakes 90*a,b,c* to be engaged. The individual engine brakes 90*a,b,c* may be engaged individually or in unison according to a predetermined engine braking strategy. Such predetermined braking strategies are known in the art and do not, of themselves, comprise part of the present invention. Thus, the particular braking strategies will not be further discussed.

In a preferred embodiment of the present invention, three levels of engine braking are available. Those levels are a low braking mode, a medium braking mode, and a high braking mode. In the low braking mode, only one of the individual engine brakes 90*a,b,c* is engaged during engine braking. In the medium braking mode, two of the individual engine brakes 90*a,b,c* are engaged during engine braking. And, in the high braking mode, all three individual engine brakes 90*a,b,c* are engaged during engine braking.

As shown in FIG. 1, the microprocessor 40 is connected to a memory device 95 by an electrical connector 96. As shown in the figure, there is a single connector 96. However, as is known in the art the connection may comprise either a parallel or serial connection, and therefore, may include more than a single connector. The present invention is not limited to the use of a single electrical connector 96 between the microprocessor 40 and the memory 95, but to the contrary, includes all other possible connections that may fall within the scope and spirit of the appended claims. Although FIG. 1 shows the microprocessor 40 and the memory device 95 as distinct devices, microprocessors that include memory are known in the art. The present invention, as defined by the appended claims, is not limited solely to the use of microprocessors and distinct memory devices, but instead includes the use of microprocessors that include memory devices.

Figure 2A:
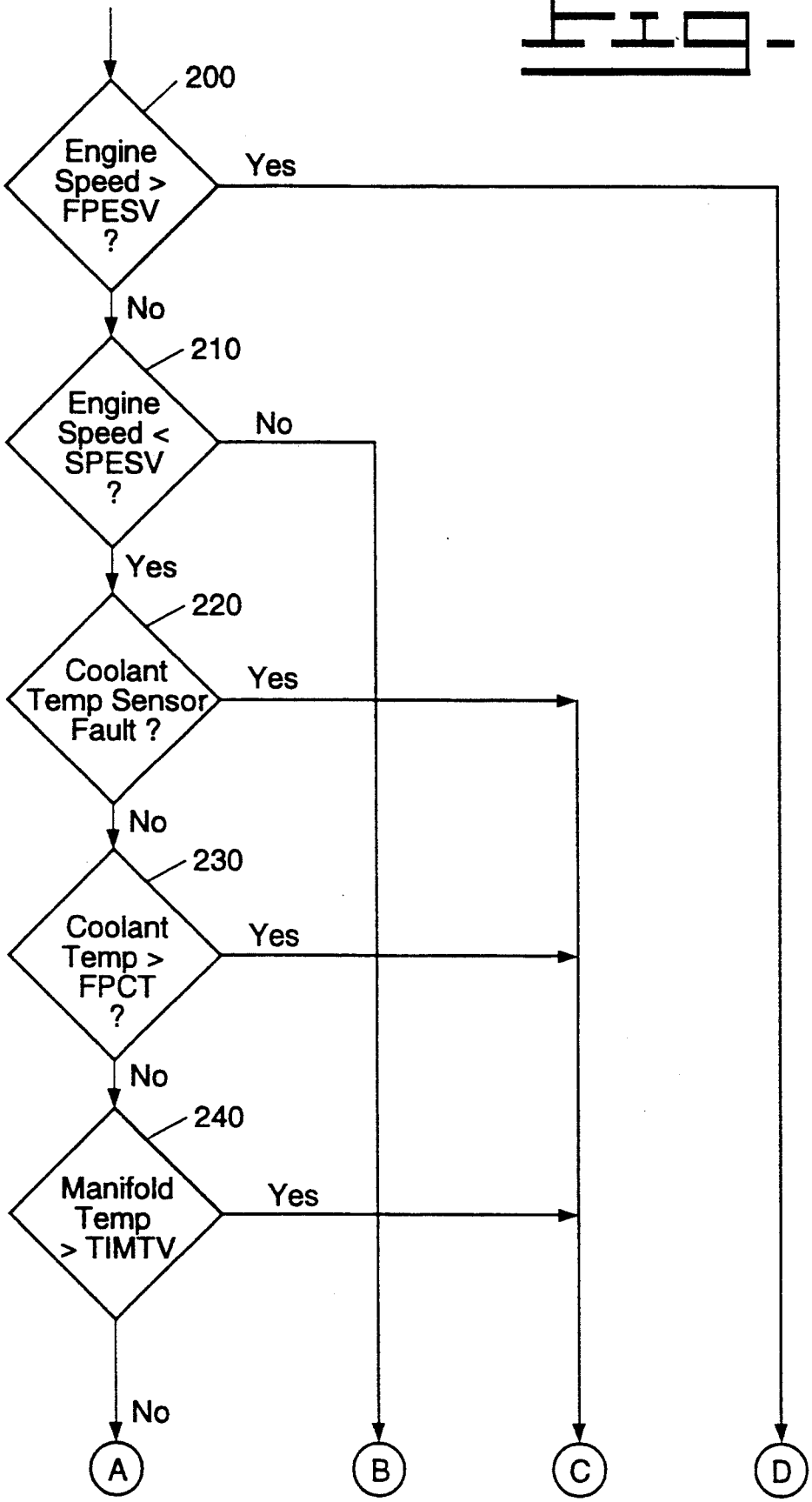
FIGS. 2(*a*) and 2(*b*) show a flowchart of the software control implemented in a microprocessor of a preferred embodiment of the electronic cooling fan control of the present invention.

Referring now to FIG. 2, a flowchart of the software control implemented by the microprocessor 40 is described. The software depicted in the flowchart is particularly well suited for use in connection with the microprocessor of the preferred embodiment. The software may be readily and easily written by those skilled in the art from the flowchart using the instruction set for that microprocessor. As would be clear to those skilled in the art, other suitable microprocessors exist which can be used in connection with the present invention and the necessary software may be readily and easily written from the flowchart using the instruction set associated with those other suitable microprocessors. Creating such software from the flowchart is a mechanical step for those skilled in the art.

In block 200, the microprocessor determines whether an engine speed signal produced by the engine speed sensor 85 corresponds to an engine speed that exceeds a first predetermined engine speed value (FPESV). In a preferred embodiment, the FPESV corresponds to an engine speed value of about 2300 revolutions per minute although it should be readily apparent that other values could be easily used. If the engine speed signal exceeds FPESV, then software control passes from block 200 to block 300. In block 300, the microprocessor issues a first signal to the fan clutch 60 over an electrical conduit 61 that activates the fan clutch 60, thereby disengaging the fan 55. In a preferred embodiment of the present invention, the microprocessor delivers either a first signal or a second signal to the fan clutch 60 over the electrical conduit 61. The first signal corresponds to a voltage level sufficient to activate the fan clutch 60 and thereby disengage the fan 55 from the engine 40. The second signal corresponds to a voltage level that deactivates the fan clutch 60 and thereby engages the fan 55 with the engine 15. In a preferred embodiment, the first signal is a voltage level that is greater than approximately 2.3 volts and the second signal is a voltage level that is less than approximately 0.7 volts. However, other voltage levels could be substituted for these values without deviating from the scope of the present invention. From block 300 control passes to block 400 where software control returns to the main program.

If the engine speed signal corresponds no an engine speed of less than FPESV then software control passes from block 200 to block 210. In block 210, the microprocessor determines whether the engine speed signal corresponds to an engine speed of less than a second predetermined engine speed value (SPESV). Inn a preferred embodiment, the SPESV corresponds to an engine speed of about 2250 RPM. However, other engine speed values can be readily used. If the engine speed signal does not correspond to an engine speed of less than about SPESV then control passes from block 210 to block 310. In block 310, the microprocessor 40 does not change the operating state of the cooling fan 55. Thus, if the cooling fan 55 is engaged prior to software control passing to block 310, then the fan will remain engaged through block 310. Likewise, if the fan is disengaged when software control passes to block 310, then the fan will remain disengaged. From block 310, control passes to block 400 and back to the main program.

If the engine speed signal corresponds to an engine speed of less than SPESV, then control passes from block 210 to block 220. In block 220, the microprocessor determines whether the coolant temperature sensor 80 or electrical conduit 81 has malfunctioned. In a preferred embodiment, the coolant temperature sensor normally produces an electrical signal that falls within the range of 0.7 to 4.3 volts depending on the sensed temperature. If the coolant temperature sensor is malfunctioning, the coolant temperature signal may fall outside that normal voltage range. If the signal produced by the coolant temperature sensor is less than about 0.7 volts or greater than about 4.3 volts, then it is assumed that the coolant temperature sensor or its electrical conduit is malfunctioning. The microprocessor then produces a coolant temperature sensor fault signal and control passes from block 220 to block 320. In block 320, the microprocessor issues the second signal to the fan clutch 60 which causes the fan clutch 60 to deactivate, thereby engaging the fan 55. From block 320, control passes to block 400 and back to the main program.

If there is no coolant temperature sensor fault in block 220, then software control passes to block 230. In block 230, the microprocessor determines whether the coolant temperature signal corresponds to a coolant temperature of greater than a first predetermined coolant temperature (FPCT). In a preferred embodiment, the FPCT value corresponds to a coolant temperature of about 96 degrees centigrade, although other values could be readily and easily used. If the engine coolant temperature exceeds the FPCT, then control passes to block 320. In block 320, the microprocessor issues the second signal, which causes the fan clutch 60 to deactivate, thereby engaging the cooling fan 55. From block 320, software control passes to block 400 and back to the main program. If the coolant temperature sensor signal corresponds to a coolant temperature of less than about the FPCT, then control passes from block 230 to block 240.

In block 240, the microprocessor determines whether the air temperature signal produced by the intake manifold temperature sensor 75 corresponds to a temperature of more than a third intake manifold temperature value (TIMTV). In a preferred embodiment, the TIMTV corresponds to a temperature of about 87 degrees centigrade, although other values may be used. If the signal from the intake manifold temperature sensor corresponds to a temperature greater than TIMTV, then control passes from block 240 to block 320. In block 320, the microprocessor issues the second signal, which deactivates the fan clutch 60 and thereby engages the fan 55. Otherwise control passes from block 240 to block 250.

In block 250, the microprocessor determines whether the air temperature signal produced by the intake manifold temperature sensor 75 corresponds to a temperature of more than a first intake manifold temperature value (FIMTV) and whether the boost pressure signal corresponds to a boost pressure exceeding the FPBV. In a preferred embodiment, the FIMTV corresponds to a temperature of about 66 degrees centigrade. If both conditions are satisfied then control passes to block 320. In block 320, the microprocessor issues the second signal to the fan clutch 60, which deactivates the fan clutch 60 and engages the cooling fan 55. From block 320, software control passes to block 400 and back to the main program. If both conditions are not satisfied, then control passes from block 250 to block 260.

In block 260, the microprocessor determines whether the engine brake is active in the high mode and has been engaged for more than a first predetermined time period (FPT) and whether the coolant temperature signal corresponds to a coolant temperature exceeding a second predetermined coolant temperature (SPCT). In a preferred embodiment, the FPT value corresponds to a length of time of about 10 seconds and the SPCT value corresponds to a coolant temperature of about 80 degrees centigrade. However, other values could be readily and easily substituted for these values. If these conditions are satisfied then software control passes to block 320. In block 320, the microprocessor issues the second signal to the fan clutch 60, which deactivates the fan clutch 60 and engages the cooling fan 55. From block 320, software control passes to block 400 and back to the main program. If both conditions are not satisfied, then control passes from block 260 to block 270.

In block 270 the microprocessor determines whether the engine speed signal produced by the engine speed sensor 85 corresponds to an engine speed exceeding a third predetermined engine speed value (TPESV) for more than a second predetermined time period (SPT). In a preferred embodiment the TPESV is about 800 RPM and the SPT is about 2 seconds, although other values could be easily and readily used. If both conditions are not satisfied, then software control passes to block 320. In block 320, the microprocessor issues the second signal to the fan clutch 60, which deactivates the fan clutch 60 and engages the cooling fan 55. From block 320, software control passes to block 400 and back to the main program. If the engine speed signal corresponds to an engine speed that exceeds TPESV for more than SPT, then control passes from block 270 to block 280.

In block 280, the microprocessor determines whether the following conditions (a) through (e) are satisfied:

(a) coolant temp<TPCT;
(b) No Manifold Temp Sensor Fault;
(c) Manifold Temp<SIMTV;
(d) Fan has been on for more than TPT; and
(e) Engine Coolant Temp<FoPCT or Engine brake is not engaged in High Mode.

TPCT and FoPCT represent a third and fourth predetermined coolant temperature, respectively; SIMTV represents a second intake manifold temperature; and TPT represents a third predetermined time period. In a preferred embodiment, the TPCT is about 92 degrees centigrade, the FoPCT is about 75 degrees centigrade, the SIMTV is about 60 degrees centigrade, and the TPT is about 30 seconds, although other suitable values could be readily and easily substituted without deviating from the scope of the present invention. If conditions (a) through (e) are satisfied, then software control passes to block 300. In block 300, the microprocessor 40 generates the first signal, which causes the fan clutch 60 to activate thereby disengaging the cooling fan 55. If, on the other hand, the conditions (a) through (e) have not been satisfied, then software control passes to block 310. In block 310 the fan operating state remains the same. From block 310 software control passes to block 400 and returns back to the main program.

As noted above, engaging the cooling fan 55 draws power from the engine 15. The power necessary to run the cooling fan is sometimes referred to as parasitic power, because that power is used internally to operate the engine and is not an output that can be used to propel a vehicle or other device. Thus, by turning the fan off in those instances where there is sufficient engine cooling, the present invention significantly reduces the parasitic power required by the cooling fan and, among other advantages, increases engine performance, gas mileage, and power output of the engine.

We claim:

1. A control for use in connection with an internal combustion engine having a plurality of combustion cylinders, an intake manifold, and a radiator, said control comprising:

a microprocessor;
a memory device electrically connected to said microprocessor;
engine cooling means for drawing air through said radiator, said engine cooling means being electrically connected to said microprocessor;
an engine brake associated with at least one of said combustion cylinders and electrically connected to said microprocessor;
a coolant temperature sensor attached to said radiator and electrically connected to said microprocessor;
an intake manifold pressure sensor connected to said intake manifold and electrically connected to said microprocessor;
an engine speed sensor electrically connected to said microprocessor; and
wherein said microprocessor engages said engine cooling means as a function of inputs from said coolant temperature sensor, said intake manifold pressure sensor, and said engine speed sensor and as a function of an output from said microprocessor to said engine brake.

2. The control according to claim 1, including:

an intake manifold temperature sensor attached to said intake manifold and electrically connected to said microprocessor; and
wherein said microprocessor engages said engine cooling means as a function of inputs from said coolant temperature sensor, said intake manifold temperature sensor, said intake manifold pressure sensor and said engine speed sensor, and as a function of an output to the engine brake.

3. The control according to claim 2, wherein said engine cooling means includes:

an engine powered fan; and
a clutch connected to said engine and said fan; and
engaging means electrically connected to said microprocessor for receiving a first signal from said microprocessor and responsively activating said clutch to disengage engine power from said fan.

4. The control means according to claim 3, wherein said engaging means deactivates said clutch in response to receiving a second signal from said microprocessor, thereby engaging said engine power to said fan.

5. The control according to claim 1, wherein said engine cooling means includes:

an engine powered fan; and
a clutch connected to said engine and said fan; and
engaging means electrically connected to said microprocessor for receiving a first signal from said microprocessor and responsively activate said clutch to disengage engine power from said fan.

6. The control means according to claim 5, wherein said engaging means deactivates said clutch in response to receiving a second signal from said microprocessor, thereby engaging engine power to said fan.

7. The control according to claim 6, wherein said engine speed sensor produces an engine speed signal as a function of measured engine speed; and wherein said microprocessor produces said first signal in response to the engine speed signal corresponding to an engine speed greater than a first predetermined engine speed value.

8. The control according to claim 7, wherein said first predetermined engine speed value is about 2300 revolutions per minute.

9. The control according to claim 7, wherein said coolant temperature sensor produces a coolant temperature signal, said coolant temperature signal value having an expected range; and wherein said microprocessor produces a coolant temperature sensor fault signal in response to said coolant temperature signal being outside said expected range.

10. The control according to claim 9, wherein said expected range for said coolant temperature signal is approximately 0.3 volts to about 4.7 volts.

11. The control according to claim 9, including timer means for producing a fan engagement signal corresponding to the length of time the fan has been engaged.

12. The control according to claim 11, wherein said microprocessor produces said first signal in response to receiving an engine speed signal corresponding to an engine speed of less than a second predetermined engine speed value, no coolant temperature sensor fault signal, said coolant temperature sensor signal corresponding to a temperature of less than a first predetermined coolant temperature, said fan engagement signal exceeding a third predetermined time period, said coolant temperature signal corresponding to a temperature less than a fourth predetermined coolant temperature value, and said engine speed signal exceeding a value corresponding to a third predetermined engine speed value for a time period greater than a second predetermined time period.

13. The control according to claim 12, wherein said second predetermined engine speed value corresponds to an engine speed of about 2250 Revolutions per minute;

said first predetermined coolant temperature corresponds to a coolant temperature of about 96 degrees centigrade;

said third predetermined time period corresponds to about thirty seconds;

said fourth predetermined engine coolant temperature value corresponds to a coolant temperature of about 75 degrees centigrade;

said third predetermined engine speed value corresponds to an engine speed of about 800 revolutions per minute; and said second predetermined time period corresponds to a time period of about 2 seconds.

14. The control according to claim 17, wherein said microprocessor produces said second signal in response to said engine speed signal corresponding to an engine speed of less than a second predetermined engine speed value, and said microprocessor producing a coolant temperature sensor fault signal.

15. The control according to claim 14, wherein said second predetermined engine speed value is about 2250 revolutions per minute.

16. The control according to claim 11, wherein said engine brake includes a plurality of individual engine brakes, each individual engine brake being engageable with two combustion cylinders.

17. The control according to claim 16, wherein each individual engine brake is electrically connected to said microprocessor; wherein each individual engine brake is engageable as a function of an output of said microprocessor; wherein said engine brake includes a plurality of levels of engine braking determined by the number of individual engine brakes that are engaged; and wherein a high level braking mode corresponds to all individual engine brakes being engaged.

18. The control according to claim 17, wherein said microprocessor produces said first signal in response to receiving an engine speed signal corresponding to an engine speed of less than a second predetermined engine speed value, no coolant temperature sensor fault signal, said coolant temperature sensor signal corresponding to a temperature of less than a first predetermined coolant temperature, said fan engagement signal exceeding a third predetermined time period, said individual engine brakes not being engaged in the high level braking mode, and said engine speed signal exceeding a value corresponding to a third predetermined engine speed value for at least a second predetermined time period.

19. The control according to claim 18, wherein: said second predetermined engine speed value corresponds to an engine speed of about 2250 Revolutions per minute;

said first predetermined coolant temperature corresponds to a coolant temperature of about 96 degrees centigrade;

said third predetermined time period corresponds to about thirty seconds;

said third predetermined engine speed value corresponds to an engine speed of about 800 revolutions per minute; and said second predetermined time period corresponds to a time period of about 2 seconds.

20. The control according to claim 17, wherein said microprocessor produces said second signal in response to said engine speed signal corresponding to an engine speed of less than a second predetermined engine speed value, and said coolant temperature signal corresponding to a coolant temperature exceeding a first predetermined coolant temperature.

21. The control according to claim 20, wherein said second predetermined engine speed value is about 2250 revolutions per minute, and said first predetermined coolant temperature is about ninety-six degrees centigrade.

22. The control according to claim 20, wherein said intake manifold temperature sensor produces air intake manifold temperature signal and wherein said microprocessor produces said second signal in response to said intake manifold temperature signal corresponding to a temperature greater than a third intake manifold temperature value.

23. The control according to claim 17, wherein said microprocessor produces said second signal in response to said engine speed signal corresponding to an engine speed of less than a second predetermined engine speed value, said individual engine brakes being engaged in the high level braking mode for more than a first predetermined time period, and said coolant temperature signal corresponding to a coolant temperature of greater than a second predetermined coolant temperature.

24. The control according to claim 23, wherein said second predetermined engine speed value is about 2250 revolutions per minute, said first predetermined time period corresponds to a time period of about 10 seconds, and said second predetermined coolant temperature corresponds to a coolant temperature of about 80 degrees centigrade.

25. The control according to claim 17, wherein said microprocessor produces an engine not running signal in response to an engine speed signal of less than a third predetermined engine speed value for greater than a second predetermined time period, and in response produces said second signal.

26. The control according to claim 25, wherein said third predetermined engine speed value corresponds to an engine speed of about 800 revolutions per minute and said second predetermined time period corresponds to about 2 seconds.

27. A method of operating an electronic fan control for use with an internal combustion engine having a plurality of combustion cylinders, an intake manifold, a radiator, a microprocessor, a memory device, engine cooling means for drawing air through said radiator, said engine cooling means electrically connected to said microprocessor, an engine brake associated with at least one of said combustion cylinders and electrically connected to said microprocessor, a coolant temperature sensor attached to said radiator and electrically connected to said microprocessor, an intake manifold pressure sensor connected to said intake manifold and electrically connected to said microprocessor, and an engine speed sensor electrically connected to said microprocessor. said method comprising the steps of:

comparing said engine speed signal to a value corresponding to a first predetermined engine speed value; and disengaging said engine cooling means in response to said engine speed signal exceeding said value corresponding to the first predetermined engine speed value.

28. The method of claim 27, including the steps of:

inputting a coolant temperature signal from said coolant temperature sensor;

comparing said coolant temperature signal to a value corresponding to a first predetermined coolant temperature;

comparing said coolant temperature signal to a high temperature limit and a low temperature limit;

producing a coolant temperature sensor fault signal in response to said coolant temperature signal being greater than said high temperature limit or less than said low temperature limit;

comparing said engine speed signal to a value corresponding to an idle speed and producing an engine running signal in response to said engine speed signal exceeding said value corresponding to the idle speed for more than a second predetermined time period;

selecting an engine braking level from a high braking level, a medium braking level and a low braking level;

disengaging said engine cooling means in response to the absence of a coolant temperature sensor fault signal, the coolant temperature signal being less than the value of the second predetermined coolant temperature, said cooling means having been engaged for greater than a first predetermined time period, and the presence of said engine running signal.

29. The method according to claim 27, including the steps of:

inputting a coolant temperature signal from said coolant temperature sensor;

comparing said coolant temperature signal to a high temperature limit and a low temperature limit;

comparing said engine speed signal to a second predetermined engine speed value;

producing a coolant temperature sensor fault signal in response to said coolant temperature signal being greater than said high temperature limit or less than said low temperature limit;

engaging said engine cooling means in response to said engine speed signal being less than said the second predetermined engine speed value, and the presence of a coolant temperature fault signal.

30. The method according to claim 27, including the steps of:

inputting a coolant temperature signal from said coolant temperature sensor;

comparing said coolant temperature signal to a first predetermined coolant temperature;

comparing said engine speed signal to a second predetermined engine speed value;

engaging said engine cooling means in response to said engine speed signal being less than the second predetermined engine speed value and said coolant temperature signal exceeding the first predetermined coolant temperature.

31. The method according to claim 27, wherein said electronic fan control includes an intake manifold temperature sensor, said method including the steps of:

inputting a boost pressure signal from said intake manifold pressure sensor;

comparing said boost pressure signal to a first predetermined boost pressure value;

inputting an intake manifold temperature signal from said intake manifold temperature sensor;

comparing said intake manifold temperature signal to a high intake manifold temperature fault value and a low intake manifold temperature fault value;

producing an intake manifold temperature sensor fault signal in response to said intake manifold temperature being greater than said high intake manifold temperature fault value or less than said low intake manifold temperature fault value;

comparing said engine speed signal to a second predetermined engine speed value;

engaging said engine cooling means in response to said engine speed signal being less than the second predetermined engine speed value, the presence of said intake manifold temperature sensor fault signal, and said boost pressure signal exceeding a value corresponding to the first predetermined boost pressure value.

32. The method according to claim 27, including the steps of:

selecting an engine braking level from a high braking level, a medium braking level and a low braking level;

comparing said engine speed signal to a value corresponding to a second predetermined engine speed;

inputting a coolant temperature signal from said coolant temperature sensor;

comparing said coolant temperature signal to a value corresponding to a second predetermined coolant temperature;

engaging said engine cooling means in response to said engine speed being less than said second predetermined engine speed and said engine braking being engaged at a high level for more than a first predetermined time period and said coolant temperature exceeding a second predetermined coolant temperature value.

33. The method according to claim 27, including the steps of:

comparing said engine speed to a value corresponding to an idle speed and producing an engine not running signal in response to said engine speed being less than said idle speed for more than a second predetermined duration of time; and comparing said engine speed signal to a value corresponding to a second predetermined engine speed;

engaging said engine cooling means in response to said engine speed signal being less than said value corresponding to the second predetermined engine speed, and the presence of said engine not running signal.

* * * * *